US006631251B2

(12) United States Patent
Morganti et al.

(10) Patent No.: US 6,631,251 B2
(45) Date of Patent: Oct. 7, 2003

(54) FUSER WEB CLEANING ASSEMBLY FOR AN ELECTROPHOTOGRAPHIC MACHINE

(75) Inventors: Terry N. Morganti, Brockport; James V. Orchard, II, Holley, both of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/775,171

(22) Filed: Feb. 1, 2001

(65) Prior Publication Data

US 2003/0156865 A1 Aug. 21, 2003

(51) Int. Cl.[7] ..... G03G 15/20
(52) U.S. Cl. ..... 399/327
(58) Field of Search ..... 399/324–327, 399/123, 122, 34

(56) References Cited

U.S. PATENT DOCUMENTS 5,170,214 A * 12/1992 Negoro et al. ..... 399/326
5,201,852 A * 4/1993 Ogoshi ..... 399/327
6,278,860 B1 * 8/2001 Morganti et al. ..... 399/327

FOREIGN PATENT DOCUMENTS

JP 53-88735 * 8/1978
JP 5-204271 * 8/1993

* cited by examiner

*Primary Examiner*—Susan S. Y. Lee

(57) ABSTRACT

An electrophotographic apparatus having a web cleaning assembly and a method for servicing web cleaning assembly. The web cleaning assembly is pivotably mounted to a slide in the fuser section of the apparatus whereby the assembly can be slid out of the fuser section and then rotated to a service position where the assembly is releasably latched while the supply and take-up rollers within the web cleaning assembly are removed and replaced.

16 Claims, 3 Drawing Sheets

FUSER WEB CLEANING ASSEMBLY FOR AN ELECTROPHOTOGRAPHIC MACHINE

FIELD OF THE INVENTION

The present invention relates to a web cleaning assembly for use in the fuser section of a electrophotographic copier/printer apparatus and in one of its aspects relates to an assembly for mounting a cleaning web within the fuser section of an electrophotographic apparatus which allows the web to be easily and quickly serviced and/or replaced from outside the fuser section housing by a single service operator.

BACKGROUND OF THE INVENTION

In a typical electrophotographic machine (e.g. copier, duplicators, printers, etc.), a continuous loop of photoconductor film is commonly used to transfer an image from an input section onto a receiving medium (e.g. a sheet of paper or the like). The film is charged and passed through an input section where an image (i.e. analog or digital) is projected onto the charged film. The film then moves through a developing section where a toner is applied to the charged image and on through an image transfer section where the image is transferred to the sheet of paper. The paper is subsequently passed through a fuser section where the toner is fixed to the paper by passing the paper between two, opposed rollers, i.e. a pressure roller and a fuser roller, one of which is heated. For example, it is common to heat the fuser roller by positioning the fuser roller in contact with one or more heater rollers which, in turn, transfer heat to the fuser roller.

A known problem in fuser sections of this type is that known as "offset" which occurs when some of the heat-softened toner particles remain on the fuser roller and are not transferred to the paper as desired. As well understood in the art, this offset can severely affect the quality of the copies being made by the machine. To alleviate this problem, a release oil is typically applied onto the fuser roller to prevent the toner from sticking thereto.

Due to the direct contact between the fuser roller and the heater rollers, the heater rollers also effectively act as cleaning rollers in that they pick up excess release oil along with other contaminants, e.g. residual toner, paper dust, etc., from the fuser roller. In turn, these contaminants must be continuously removed from the heater rollers during the copying operation in order to maintain high quality copies from the machine. Accordingly, most machines of this type now include some means for continuously "cleaning" these contaminants off of the heater rollers during the copying operation.

One known way to clean the heater rollers of this type machine is to position a web cleaning assembly within the fuser section of the machine which includes a cleaning material which, in turn, continuously "wipes" the contaminants off of the fuser roller when the machine is in operation. This cleaning material is typically a substantial length of a web of cleaning material (i.e. woven material such as NOMEX) is wound onto a supply roller in the web cleaning assembly. During the copying operation, the web of material contacts the heater rollers as the material is advanced off of the supply roller and onto a take-up roller which, in turn, is also mounted in the cleaning assembly. Since the web material is regularly advanced during the copying operation, the initial supply of web material on the supply roller will ultimately run out and will need to be replaced in order to maintain the quality of the copies being made by the machine. That is, the take-up roller with the used web thereon and the old, now empty supply roller will both need to be removed and replaced with new ones whenever the supply of web material runs out.

Since these rollers will need to be replaced on a relatively frequent basis, the procedure for changing out the rollers should be as easy and as mistake proof as possible. Preferably, this can be simple enough that an operator of the machine, vis-à-vis a dedicated service technician, can be given minimal training to perform this task as needed thereby averting a service call each time the web material runs out thereby significantly reducing the operating costs of the machine.

In known prior-art machines of this type, the supply roller is normally replaced by an experienced technician who pulls the web cleaning assembly out from the fuser section on a slide rail which is mounted within the fuser section housing. Due to the position of the cleaning assembly within the fuser housing during the copying operation, the cleaning assembly, once pulled from the housing, will hang on the slide rail such that the take-up roller is on the low side of the frame of the assembly thereby making it difficult for the technician to access or view the take-up roller without kneeling in an awkward position. A spring-loaded pin is pulled out of one end of the take-up roller which is then lifted off a pin at the other end. Once one roller (e.g. full take-up roller) is free, the other roller (e.g. empty supply roller) must be removed in a similar manner.

Further, such known cleaning assemblies have no provisions for the technician to set one roller down while he removes or works on the other roller thereby requiring the technician to hold the free roller while he is removing/replacing the other roller. This, too, can prove awkward and challenging for a single technician. As will be recognized, this relatively difficult and sophisticated procedure can substantially add to the downtime and maintenance costs of the machine being serviced. Accordingly, the advantages of having ready and easy access to the web cleaning assembly so that the web of cleaning material can easily and quickly be removed and replaced by a single operator should be readily apparent.

SUMMARY OF THE INVENTION

The present invention provides an electrophotographic apparatus having a fuser section which includes a web cleaning assembly and a method for servicing the web cleaning assembly to remove and replace the supply and take-up rollers therein. Basically, the web cleaning assembly is pivotably connected to a slide in the housing of the fuser section so that the web cleaning assembly can be slid out of the housing and then rotated to a service position in which the supply and take-up rollers are easily accessible for servicing.

More specifically, the present invention relates to an electrophotographic apparatus having a fuser section which, in turn, includes a web cleaning assembly. The web cleaning assembly includes a supply roller on which a web of cleaning material is wound and a take-up roller which receives the used cleaning material after the material has contacted and removed contaminants from the heater rollers in the fuser section of the apparatus.

The frame of web cleaning assembly has a front and a back which are connected together by a base element. The frame is connected to a telescopic slide in the housing of the fuser section by a pivot connection so that the web cleaning assembly can be slid out of the housing and then rotated from its operable position to a service position. A releasable latch is provided to latch the assembly in the service position. The pivot connection is formed by a pair of slidable pins on the frame which are rotatably received by supports on the slide. These pins can be retracted from the supports on the slide so that the web cleaning assembly can completely removed from the slide when desired.

Both the supply roller and the take-up rollers are releasably mounted in the frame in that a first end of each respective roller is slidably received within a respective first journal box which, in turn, is mounted in the back of the frame. The other or second end of each of each roller is received in its respective second journal box which, in turn, is slidably mounted in the front of the frame so that the second journal boxes can be moved between an operable position where the second ends of the rollers are positioned therein and a retracted position where the second ends of the rollers are free thereof.

From the above, it can be seen that the supply and take-up rollers within the web cleaning assembly can quickly and easily be serviced by sliding the assembly out of the fuser section and then rotating and latching the assembly in a service position. This provides ready access to both of the rollers which can then be quickly removed by retracting the second journal boxes and sliding the rollers out of their respective first journal boxes. New supply and take-up rollers can then be installed by reversing the above-described, removal procedure. The web cleaning assembly is then released from the service position, rotated back to the original or operable position, and then slid back into the fuser section.

BRIEF DESCRIPTION OF THE DRAWINGS

The actual construction operation, and apparent advantages of the present invention will be better understood by referring to the drawings, not necessarily to scale, in which like numerals identify like parts and in which.

DESCRIPTION OF THE PREFERRED EMBODIMENTS

Figure 1:
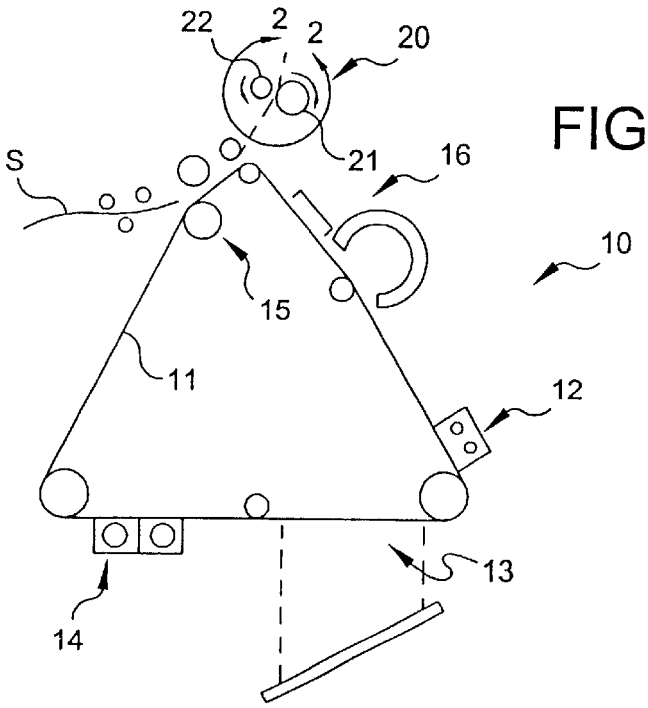
FIG. 1 is a schematic view of an electrophotographic apparatus (e.g. copier/printer machine) in which the present invention can be incorporated.

Referring briefly to FIG. 1, a typical electrophotographic apparatus or machine 10 (e.g. copier, duplicator, printer) of the kind that has an endless photoconductor member 11 (e.g. photographic film) which moves through a closed loop past a charging station 12, a an exposure or input station 13, a developing station 14, a transfer station 15, and an erase section 16. A copy medium (e.g. a sheet S of paper) is fed from a supply (not shown) through transfer station 15 where the toner image on the film 11 is transferred onto the paper S. The paper S is then fed between a fuser roller 21 and a pressure roller 22 in fuser section 20 to fix the toner image on the paper S before the paper exits the machine.

Figure 2:
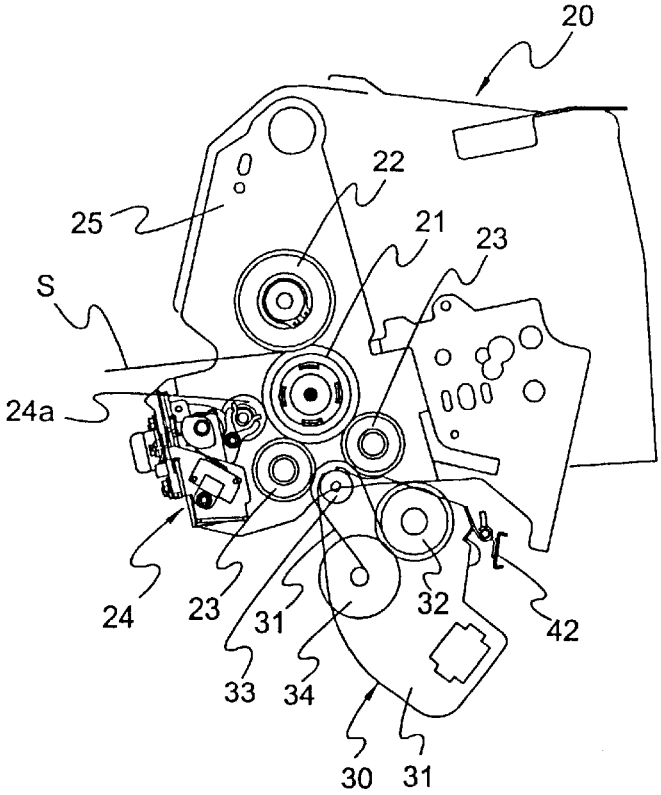
FIG. 2 is a cross-section view of a fuser section such as that lying within line 2—2 of FIG. 1 having the web cleaning assembly of the present invention incorporated thereon.

FIG. 2 is a cross-sectional view of a typical fuser section 20 which might be found in the electrophotographic machine 10 of FIG. 1. As illustrated, fuser section 20 is comprised of a frame or housing 25 in which pressure roller 22, fuser roller 21, and two heating rollers 23 are rotatably mounted. As will be understood in the art, a motor (not shown) mounted on the housing 25 rotates pressure roller 22 which, in turn, rotates fuser roller 21 through the frictional contact therebetween. Fuser roller 21 is heated by heating rollers 23 so that when the sheet of paper S or the like passes through the nip between rollers 21, 22, the heat and pressure exerted thereby will cause the toner carried on S to become fused on the paper.

However, in fusers of this type, some of the toner particles are likely to adhere to fuser roller (i.e. "toner offset") which can severely affect the quality of the copies being made. To alleviate this problem, a wick roller assembly 24 is positioned within housing 25 and includes a wick roller 24*a* for applying a "release" oil directly onto fuser roller 21. This oil helps to prevent "offset", i.e. prevents toner from sticking to the fuser roller. Unfortunately, excess oil along with residual toner, paper dust, etc., may build-up on the fuser roller and be transferred to and contaminate heater rollers 23. If these contaminants are not removed from the heater rollers, they quickly affect the quality of the copies being made by the machine.

To remove these contaminants, a web cleaning assembly 30 is provided within fuser housing 25 which includes a web 31 of material which contacts the heater rollers 23 to "wipe" and remove the contaminants therefrom as the copying operation is being carried out. As is known in the art, web 31 may be comprised of any flexible, cleaning material which is capable of removing the contaminants from the heater rollers upon contact (e.g. woven cloth-like material such as NOMEXOR®) without damaging the heater rollers. The cleaning material 31 is wound onto supply roller 32 and passes over tensioner roller 33 and onto take-up roller 34. Tensioner roller 33 holds material in contact with both of heater rollers 23 when assembly 30 is in its operable position (FIGS. 2 and 4) within fuser housing 25.

Since the cleaning material 31 is continuously advanced during the copying operation, the web of cleaning material will ultimately run out and will have to be replaced on a routine basis. Since, as will be appreciated, housing 25 is also filled with a sophisticated maze of electrical and mechanical components (not shown for clarity), this servicing of web cleaning assembly 30 and the replacement of supply roller 32 should be as easy and uncomplicated as possible in order to keep maintenance costs to a minimum.

Referring now to FIGS. 3-8, the details of the web cleaning assembly 30 of the present invention are further described below. In FIGS. 3, 5, 7, and 8, supply roller 32 and take-up roller 34 have been removed from assembly 30 and are not shown for the sake of clarity. Web cleaning assembly 30 is comprised of a frame 35 having a front 36 and a back 37 which, in turn, are connected by base element 38. Base element 38 has a shelf 38*a* formed on one side thereof (FIGS. 7 and 8) and a slot 38*b* formed in the other side (FIGS. 5 and 8) for purposes described below.

Tensioner roller 33 is rotatably mounted in frame 35 near the top thereon and extends between front 36 and back 37 of frame 35. Supply roller 32 and take-up roller 34 are releasably secured for rotation in frame 35 on either side and below the intermediate, tensioner roller 32. Preferably, a first end of each roller (i.e. the end of the axle, not shown, of each roller) slidably fits into a respective first journal box 39 (FIGS. 3, 5, and 7) which, in turn, is mounted in back 37 of frame 35. Each journal box 39 has a gear 39*a* secured to its outer end which, in turn, are meshed and driven by a gear 40*a* on motor 40. The respective gears are sized to rotate the supply and take-up rollers, at their respective, required speeds during the copying operation so that material is taken up by roller 34 as it is fed from supply roller 32.

The other or second end of each roller axis is slidably positioned within a respective, second journal box 40 which, in turn, is slidably or retractably mounted in the front 36 of frame 35. If desired, second journal boxes 40 may be biased inwardly towards their operable positions by springs (not shown). The knob on each journal box 40 is used to pull a respective journal box 40 away from its respective roller to a retracted position wherein the second end of that respective roller is released. Once the second end of a respective roller is released from retractable journal box 40, the first end of the roller can then be slid out of its respective journal box 39 thereby freeing that roller for removal from frame 35. This procedure is reversed to install a new respective roller.

To position web cleaning assembly 30 in its operable position within fuser housing 25 and to remove it therefrom, the web cleaning assembly 30 is mounted on a telescoping slide 42 which, in turn, is properly mounted and aligned in the fuser housing 25. As illustrated, slide 42 is comprised of a plurality of elements 42*a*, 42*b*, 42*c* (three shown in FIGS. 3 and 5) which are slidably connected together in a telescopic relationship and which are movable between a retracted position (i.e. when assembly 30 is in its operable position within fuser housing 25) and an extended position (i.e. when assembly 30 is outside fuser housing 25, FIGS. 3 and 5). A releasable latch or detent 42*d* on the outer end of the outermost element 42*c* cooperates with a notch or the like on innermost element 42*a* when slide 42 is in its retracted position to releasably latch the slide in the retracted position as will be understood in the art.

Figure 3:
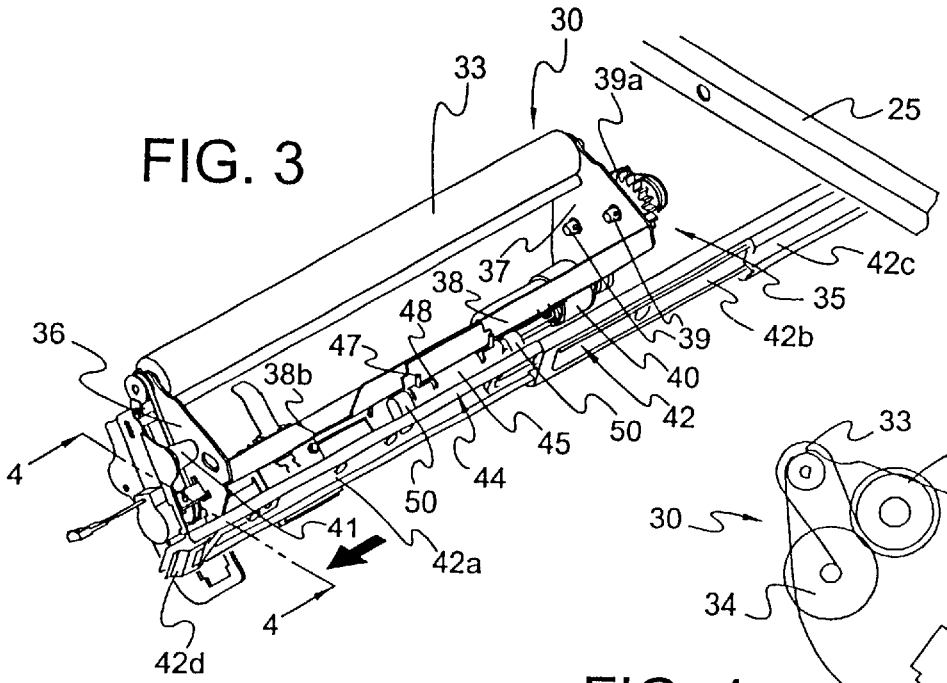
FIG. 3 is a partial, perspective view of the web cleaning assembly of FIG. 2, having the supply and take-up rollers removed for clarity, and a portion of the fuser section housing wherein said assembly has been slid out of said housing while in an operable position.
Figure 5:
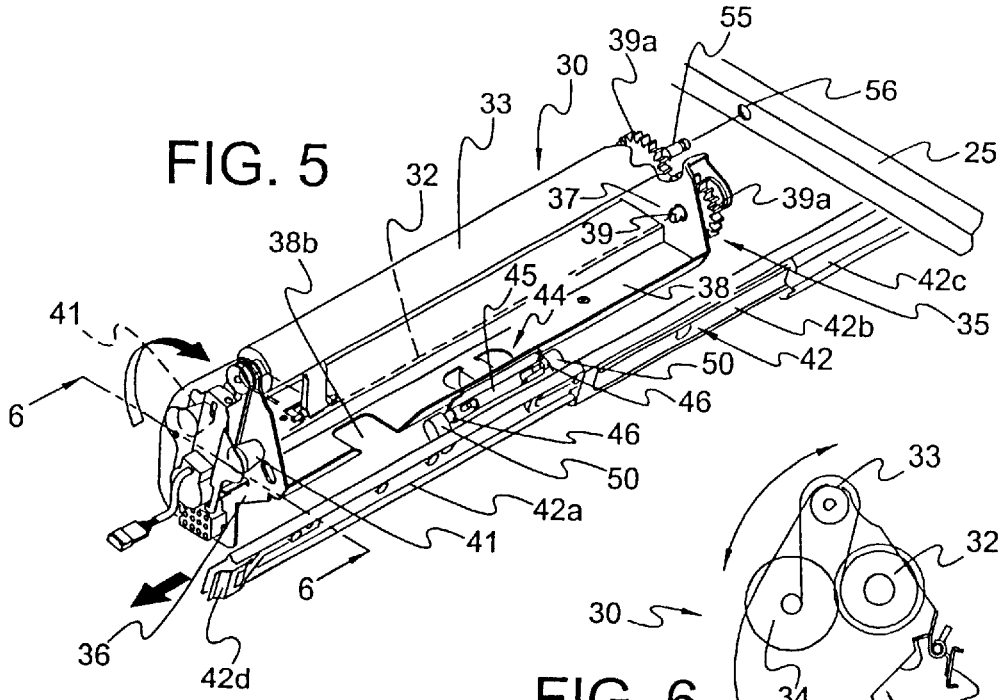
FIG. 5 is a partial perspective view of the web cleaning assembly of FIG. 3 wherein said assembly has been rotated to a service position.
Figure 8:
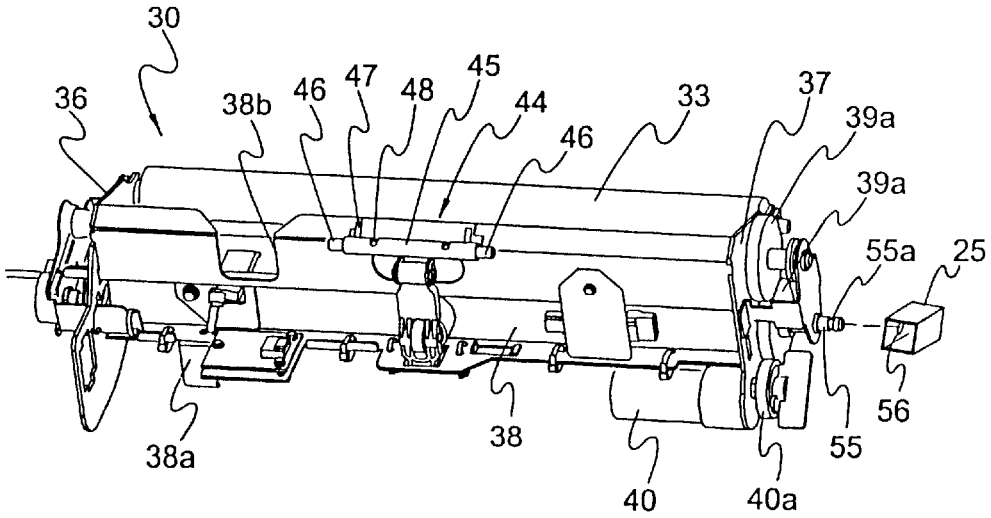
FIG. 8 is a perspective view of bottom of the web cleaning assembly of FIG. 3.

The assembly 30 is affixed to slide 42 by a pivot connection 44 which allows the assembly to rotate with respect to slide 42 and at the same time, allows assembly 30 to be completely removed from the slide if the need arises during servicing. As best seen in FIGS. 3, 5, and 8, pivot connection 44 is comprised of a sleeve 45 which is affixed to the base support 38 of frame 35 of assembly 30 and a pair of spaced journal. supports 50 on slide 42. Two pivot pins 46 are slidably mounted within sleeve 45 with one of the pivot pins extending from a respective end of the sleeve. The pivot pins 46 can be normally biased outwardly from the ends of sleeve 45 by a spring or the like (not shown) which, in turn, is positioned in the sleeve or they can be moved manually. Each pivot pin 46 has a lug or handle 47 thereon (only one numbered for clarity) which can be used to move the pivot pin inwardly and then rotated into an L-shaped slot 48 or the like in the sleeve 45 to hold the pins in their retracted position during removal/replacement of the assembly 30.

Once frame 35 of assembly 30 is properly positioned with respect to slide 42, pins 46 are released from slots 48 and are moved outward into journal recesses in journal supports 50 to thereby form pivot connection 44. It can be seen that frame 35 of assembly is affixed to and is carried by slide 42 but is free to rotate with respect thereto when the frame is clear of housing 25.

Figure 4:
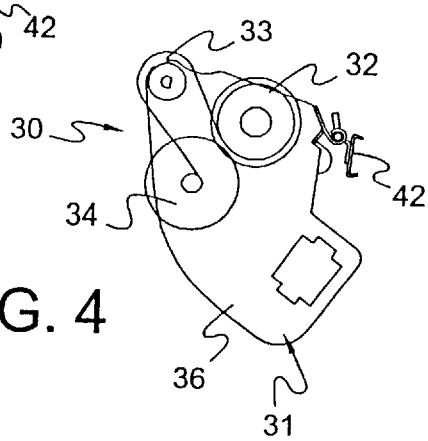
FIG. 4 is a simplified front view of the web cleaning assembly of FIG. 3 taken along lines 4—4 of FIG. 3 with the supply and take-up rollers in place.
Figure 6:
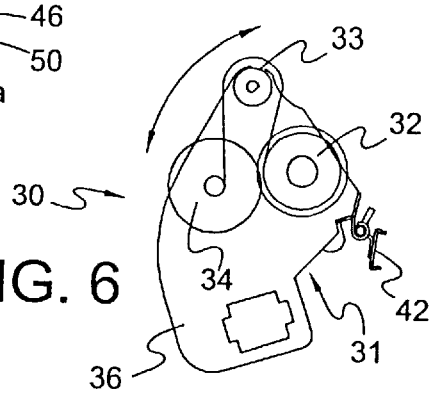
FIG. 6 is a simplified front view of the web cleaning assembly of FIG. 5 taken along lines 6—6 of FIG. 5 with the supply and take-up rollers in place.
Figure 7:
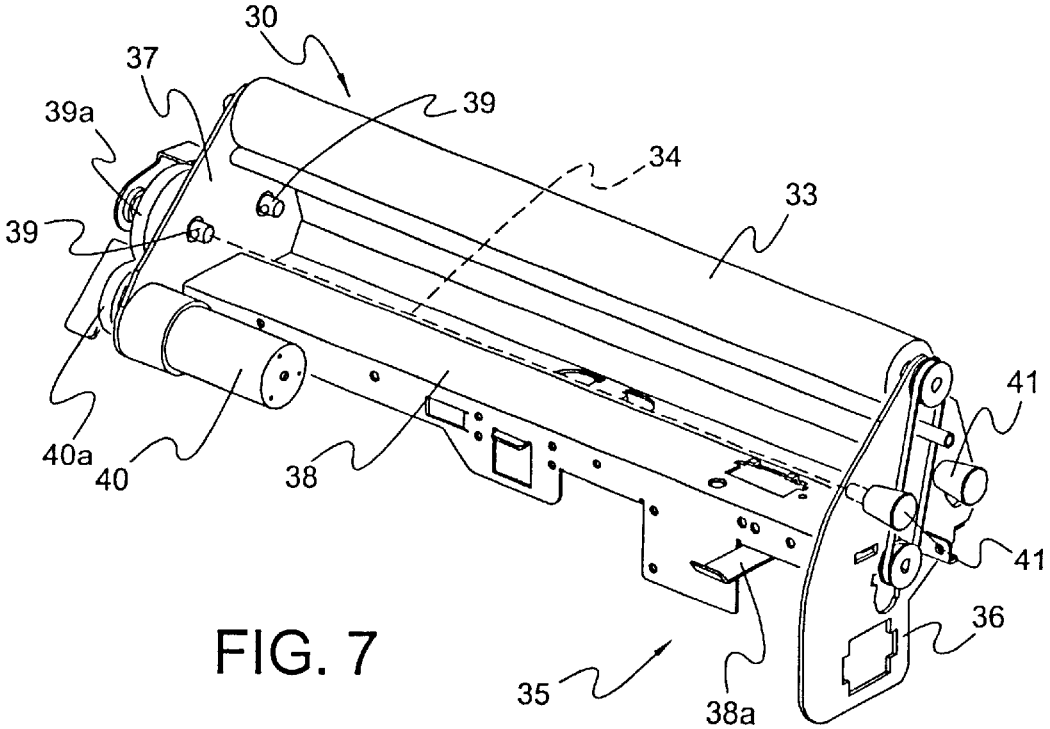
FIG. 7 is a perspective view of one side of the web cleaning assembly of FIG. 3.

When the supply of web material 31 on supply roller 32 has been exhausted, detent 42*d* on slide 42 is released and assembly 30 is pulled forward until it clears fuser housing 25 (FIGS. 3 and 4). As best seen in FIG. 4, in this operable position, take-up roller 34 is on the low side of the frame 35 and is in a position which is not readily accessible to a service person without kneeling in an awkward position. In accordance with the present invention, frame 35 of web cleaning assembly 30 is rotated (i.e. clockwise as viewed in FIGS. 4 and 6) to its service position (FIGS. 5 and 6). In the service position, the take-up roller 34 is readily accessible to the service person without kneeling.

Once the web cleaning assembly 30 has been rotated to the service position, it is secured in that position by a releasable latch mechanism which, in turn, is comprised of a latch pin 55 (FIGS. 5 and 8) on frame 35 which is adapted to be received in hole 56 on fuser housing 25. Latch pin 55 is preferably aligned with the axis of take-up roller 34 and extends out from the back 37 of frame 35. Pin 55 has a circumferential groove 55*a* (FIG. 8) thereon which engages the lower edge of hole 56 when the pin is in the hole to prevent the pin from accidentally slipping out of the hole during servicing. When assembly 30 has been rotated and pin 55 is aligned with hole 56, assembly 30 is then pushed back toward housing 25 to move pin 55 into hole 56, thereby latching the assembly in the service position.

With assembly 30 latched in its service position, the service person now retracts journal box 41 on take-up roller 34 and lifts and pulls the now-full, take-up roller 34 from its other journal box 39 and lays the take-up roller onto shelf 38*a* on frame 35. The service person's hands are now free to remove the now-empty supply roller 32 in the same manner after which both the take-up roller and the supply roller can be removed together. Slot 38*b* in the support element 38 allows the service person better access to grip and handle the supply roller during removal and replacement thereof.

A new supply roller 32 having a new supply of web material 31 wound thereon and a new empty roller 34 can now be installed by merely reversing the above described procedure. Once the new rollers are in place, assembly 30 is slightly lifted and moved outward to remove pin 55 from hole 56 to thereby unlatch frame 35 from housing 25. Assembly 30 is then rotated back to its original or operable position (FIG. 4) and is pushed back into the fuser housing 25 until detent 42*d* latches the slide 42 in its fully retracted position.

It should be evident from the above that the web cleaning assembly 30 can be serviced and/or replaced, easily and quickly, by a single, minimally trained service person without the need for any special tools or assistance. This is very important in reducing the costs and the down time normally associated with machines of this type.

What is claimed is:

1. An electrophotographic apparatus having a fuser section, said fuser section comprising:

a housing;

a fuser roller mounted in said housing;

at least one heater roller mounted in said housing and in contact with said fuser roller for transferring heat thereto; and a web cleaning assembly in said housing for cleaning contaminants off of said at least one heater roller, said web cleaning assembly comprising:

a frame having a front and a back a base element connecting said front to said back;

a supply roller releasably mounted between said front and said back of said frame for relative rotation therewith, said supply roller adapted to have a web of cleaning material wound thereon;

a take-up roller releasably mounted between said front and said back of said frame for relative rotation therewith, said take-up roller adapted to receive said web of said cleaning material as said material is fed off of said supply roller;

a tension roller rotatably mounted between said front and said back of said frame, said tension roller being positioned intermediate of said supply roller and said take-up roller and adapted to have said web of cleaning material pass thereover as said web of said cleaning material moves between said supply roller and said take-up roller, said tension roller being positioned to engage said at least one heater roller when said web cleaning assembly is in an operable position within said fuser section wherein said web of cleaning material will contact said at least one heater roller;

a slide mounted in said housing; and a pivot connection for pivotably connecting said frame of said web cleaning assembly to said slide wherein said web cleaning assembly can be slid out of said housing on said slide and then rotated with respect to said slide to move said web cleaning assembly from an operable position to a service position.

2. The electrophotographic apparatus of claim 1 including:

a latch mechanism for releasably securing said web cleaning assembly in said service position.

3. The electrophotographic apparatus of claim 2 wherein said latch mechanism comprises:

a latch pin extending outward from said back of said frame; and a hole in said housing which aligns with said latch pin when said web cleaning assembly is in said service position.

4. The electrophotographic apparatus of claim 2 wherein said pivot connection comprises:

a pair of pivot pins mounted on said base element of said frame; and a pair of journal supports on said slide adapted to rotationally receive said pair of pivot pins, respectively.

5. The electrophotographic apparatus of claim 2 wherein said pivot connection comprises:

a sleeve mounted on said base element of said frame;

a pair of pivot pins slidably positioned within said sleeve, each of said pair of pivot pins extending a respective end of said sleeve; and a pair of journal supports spaced on said slide and adapted to rotatably receive said pair of pivot pins, respectively.

6. The electrophotographic apparatus of claim 5 wherein said slide comprises:

a plurality of elements slidably connected together in a telescopic relationship and movable between a retracted position and an extended position.

7. The electrophotographic apparatus of claim 6 including:

a releasable latch for securing said slide in said retracted position.

8. An electrophotographic apparatus having a fuser section, said fuser section comprising:

a housing;

a fuser roller mounted in said housing;

at least one heater roller mounted in said housing and in contact with said fuser roller for transferring heat thereto; and a web cleaning assembly in said housing for cleaning contaminants off of said at least one heater roller, said web cleaning assembly comprising:

a frame having a front and a back a base element connecting said front to said back;

a supply roller adapted to have a web of cleaning material wound thereon; said supply roller having a first end and a second end;

a first supply roller journal box mounted on said back of said frame, said first journal box adapted to slidably receive said first end of said supply roller;

a second supply roller journal box slidably mounted in said front of said frame and movable between an operable position and a retracted position, said second journal box adapted to slidably receive said second end of said supply roller when in said operable position;

a take-up roller adapted to receive said web of said cleaning material as said material is fed off of said supply roller;

a first take-up roller journal box mounted on said back of said frame, said first journal box adapted to slidably receive said first end of said take-up roller;

a second take-up roller journal box slidably mounted in said front of said frame and movable between an operable position and a retracted position, said second journal box adapted to slidably receive said second end of said take-up roller when in said operable position;

a tension roller rotatably mounted between said front and said back of said frame, said tension roller being positioned intermediate of said supply roller and said take-up roller and adapted to have said web of cleaning material pass thereover as said web of said cleaning material moves between said supply roller and said take-up roller, said tension roller being positioned to engage said at least one heater roller when said web cleaning assembly is in an operable position within said fuser section wherein said web of cleaning material will contact said at least one heater roller;

a slide mounted in said housing; and a pivot connection for pivotably connecting said frame of said web cleaning assembly to said slide wherein said web cleaning assembly can be slid out of said housing on said slide and then rotated with respect to said slide to move said web cleaning assembly from an operable position to a service position.

9. The electrophotographic apparatus of claim 8 including:

a latch mechanism for releasably securing said web cleaning assembly in said service position wherein said latch comprises:

a latch pin extending outward from said back of said frame; and a hole in said housing which aligns with said latch pin when said web cleaning assembly is in said service position.

10. The electrophotographic apparatus of claim 9 including:

a shelf affixed to said base element for supporting said take-up roller when said take-up roller is removed from said frame.

11. The electrophotographic apparatus of claim 9 including:

a slot formed in said base element to provide ready access to said supply roller when said supply roller is in an operable position within said frame.

12. The electrophotographic apparatus of claim 9 wherein said pivot connection comprises:

a sleeve mounted on said base element of said frame;

a pair of pivot pins slidably positioned within said sleeve, each of said pair of pivot pins extending from a respective end of said sleeve; and a pair of journal supports spaced on said slide and adapted to rotatably receive said pair of pivot pin, respectively.

13. The electrophotographic apparatus of claim 12 wherein said slide comprises:

a plurality of elements slidably connected together in a telescopic relationship and movable between a retracted position and an extended position.

14. The electrophotographic apparatus of claim 13 including:

a releasable latch for securing said slide in said retracted position.

15. A method for servicing a supply roller and a take-up roller within a web cleaning assembly which is positioned within the housing a fuser section of an electrophotographic apparatus, said method comprising:

sliding said web cleaning assembly out of said housing and supporting said assembly on a slide mounted in said housing;

rotating said web cleaning assembly with respect to said slide to rotate said web cleaning assembly from an operable position to a service position;

removing said supply roller and said take-up roller from said web cleaning assembly;

installing a new supply roller and a new take-up roller in said web cleaning assembly;

rotating said web cleaning assembly back to said operable position; and sliding said web cleaning assembly back into said housing.

16. The method of claim 15 including releasably securing said web cleaning assembly in said service position before removing said supply and said take-up rollers; and releasing said web cleaning assembly from said service position after said new supply and take-up rollers have been installed.

* * * * *